US008567004B2

(12) United States Patent
Boulanger et al.

(10) Patent No.: US 8,567,004 B2
(45) Date of Patent: Oct. 29, 2013

(54) DE-ICING LIQUID RECOVERY DEVICE

(75) Inventors: Guy Charles Boulanger, Dartmouth (CA); Adel al Taweel, Halifax (CA)

(73) Assignee: Inland Technologies Holdings, Inc., Truro, Nova Scotia (CA)

( * ) Notice: Subject to any disclaimer, the term of this patent is extended or adjusted under 35 U.S.C. 154(b) by 870 days.

(21) Appl. No.: 12/660,792

(22) Filed: Mar. 4, 2010

(65) Prior Publication Data

US 2011/0214251 A1 Sep. 8, 2011

(51) Int. Cl.
*A47L 7/00* (2006.01)

(52) U.S. Cl.
USPC ..... 15/322; 15/320; 15/321; 15/345

(58) Field of Classification Search
USPC ..... 15/320, 321, 322, 345
See application file for complete search history.

(56) References Cited

U.S. PATENT DOCUMENTS

| | | | | |
|---|---|---|---|---|
| 5,311,638 | A * | 5/1994 | Furcron et al. | 15/321 |
| 7,171,722 | B2 * | 2/2007 | Keller | 15/322 |
| 7,290,307 | B1 * | 11/2007 | Chao | 15/322 |
| 2004/0045118 | A1 * | 3/2004 | Wydra et al. | 15/320 |

* cited by examiner

*Primary Examiner* — Lee D Wilson
*Assistant Examiner* — Shantese McDonald
(74) *Attorney, Agent, or Firm* — Frank J. Bonini, Jr.; John F. A. Earley, III; Harding, Earley, Follmer & Frailey, P.C.

(57) ABSTRACT

A device for recovering a liquid disposed on a solid surface is provided. The device for recovering a liquid comprises a suction device for providing suction to a pickup head and a blowing device for providing an airflow to the pickup head. The pickup head comprises at least an input port for receiving an airflow and a blower opening for providing the airflow to the solid surface. A blower deflector directs the airflow through the blower opening at an acute angle to the solid surface. The airflow and an airborne portion of the liquid is received at a suction opening which is in fluid communication with at least an output port for being connected to a suction device providing suction. The received airflow with the airborne portion of the liquid is provided through the at least an output port. A divider is disposed between the blower opening and the suction opening. A separator is in fluid communication with the suction device and the at least an output port of the pickup head. The separator provides suction to the at least an output port of the pickup head, receives the airflow and the airborne portion of the liquid and separates the airborne portion of the liquid from the airflow. The separator comprises at least two sets of baffles disposed in series such that the airflow successively encounters the sets of baffles in order of decreasing coarseness and collector disposed below the sets of baffles for collecting the liquid accumulated on the baffles through gravitational action.

13 Claims, 9 Drawing Sheets

DE-ICING LIQUID RECOVERY DEVICE

BACKGROUND OF THE INVENTION

1. Field of the Invention

The present invention relates to a device for recovering a liquid disposed on a solid surface, and more particularly to a de-icing liquid recovery device for recovering de-icing liquid disposed on airport runways and gate locations after de-icing of an aircraft.

2. Brief Description of the Related Art

Icing of aircrafts is a serious problem in cooler climates and has resulted in numerous aircraft crashes killing a substantial number of passengers and air crew. Therefore, de-icing of aircraft prior to take-off has become a routine process at airports located in cooler climates.

Typically, aircraft are de-iced using a de-icing liquid such as, for example, a glycol/water solution. However, de-icing liquids are generally environmentally unfriendly and potentially hazardous materials which have to be prevented from entering the ground or the airport storm water system.

Devices for recovering de-icing liquid disposed on the surface of runway or gate location are typically mounted on a truck and comprise either a vacuum system or a combined vacuum—forced recirculated air system connected to a pickup head which is moved over the surface for removing the de-icing liquid and other material such as, for example, slush, sand, and dirt disposed on the surface through suction. A cyclone system or other separation system then separates the de-icing liquid and the other material from the airflow produced by the vacuum system, or combined vacuum—forced recirculated air system.

Unfortunately, using state of the art equipment is generally inefficient in its use of energy. Furthermore, state of the art cyclone systems or other separation systems used for separating the de-icing liquid and the other material from the airflow cause substantial flow restriction to the air flow which has to be overcome by the vacuum system or combined vacuum—forced recirculated air system.

It is desirable to provide a pickup head for a de-icing liquid recovering device having increased utilization of the air flow for removing the de-icing liquid and the other material from the surface.

It is desirable to provide a separator for a de-icing liquid recovering device having increased efficiency by substantially reducing the flow restriction to the air flow.

SUMMARY OF THE INVENTION

Accordingly, one object of the present invention is to provide a de-icing liquid recovering device having increased utilization of the air flow for removing the de-icing liquid and the other material from the surface.

Another object of the present invention is to provide a de-icing liquid recovering device having increased efficiency by substantially reducing the flow restriction to the air flow.

According to one aspect of the present invention, there is provided a pickup head for removing a liquid disposed on a solid surface. The pickup head comprises at least an input port for receiving an airflow and a blower opening for providing the airflow to the solid surface. A blower deflector directs the airflow through the blower opening at an acute angle to the solid surface. The airflow and an airborne portion of the liquid is received at a suction opening which is in fluid communication with at least an output port for being connected to a suction device providing suction. The received airflow with the airborne portion of the liquid is provided through the at least an output port. A divider is disposed between the blower opening and the suction opening.

According to the aspect of the present invention, there is further provided a device for recovering a liquid disposed on a solid surface. The device for recovering a liquid comprises a suction device for providing suction to a pickup head and a blowing device for providing an airflow to the pickup head. The pickup head comprises at least an input port for receiving an airflow and a blower opening for providing the airflow to the solid surface. A blower deflector directs the airflow through the blower opening at an acute angle to the solid surface. The airflow and an airborne portion of the liquid is received at a suction opening which is in fluid communication with at least an output port for being connected to a suction device providing suction. The received airflow with the airborne portion of the liquid is provided through the at least an output port. A divider is disposed between the blower opening and the suction opening. A separator is in fluid communication with the suction device and the at least an output port of the pickup head. The separator provides suction to the at least an output port of the pickup head, receives the airflow and the airborne portion of the liquid and separates the airborne portion of the liquid from the airflow.

According to another aspect of the present invention, there is yet further provided a separator for separating a liquid from an airflow. The separator comprises an input port for receiving the airflow containing the liquid, an output port for providing the airflow after separation of the liquid there from and at least two sets of baffles in fluid communication with the input port and the output port. The sets of baffles have different predetermined coarseness and are disposed in series such that the airflow successively encounters the sets of baffles in order of decreasing coarseness. A collector disposed below the sets of baffles collects the liquid accumulated on the baffles through gravitational action.

The advantage of the present invention is that it provides a de-icing liquid recovering device having increased utilization of the air flow for removing the de-icing liquid and the other material from the surface.

A further advantage of the present invention is that it provides a de-icing liquid recovering device having increased efficiency by substantially reducing the flow restriction to the air flow.

BRIEF DESCRIPTION OF THE DRAWINGS

A preferred embodiment of the present invention is described below with reference to the accompanying drawings, in which.

DESCRIPTION OF THE PREFERRED EMBODIMENT

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are now described.

The description of the preferred embodiments herein below is with reference to a de-icing liquid recovery device for use on a recycling vehicle of the type used at airports to remove and recover typically a water/glycol solution—of relatively low concentration averaging approximately 5% over a season in some locations and seldom exceeding a 50% concentration—used to de-ice aircraft. However, it will become evident to those skilled in the art that the embodiments of the invention are not limited thereto, but are also applicable for recovering various other substantially non-flammable water based solutions which are disposed as a film on a solid surface.

Figure 1A:
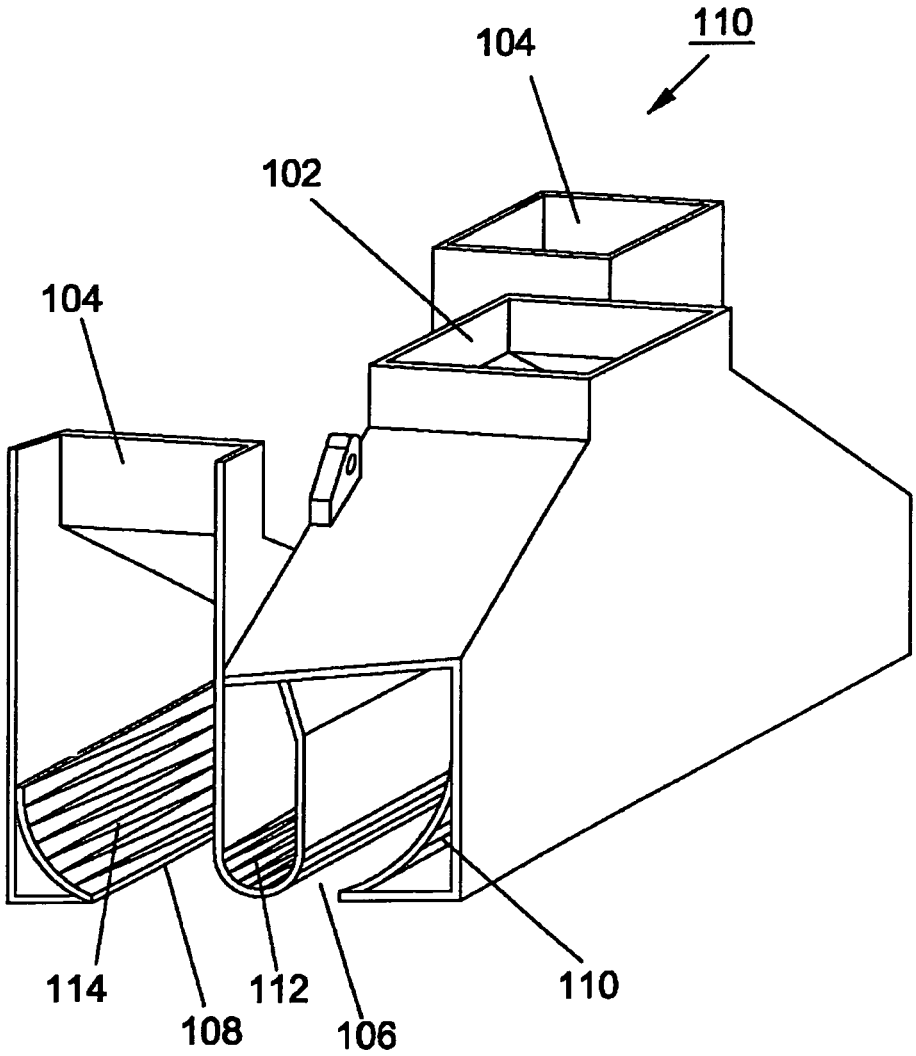
FIG. 1A is a partial cutaway of a perspective view of a pickup head according to a preferred embodiment of the invention.
Figure 1B:
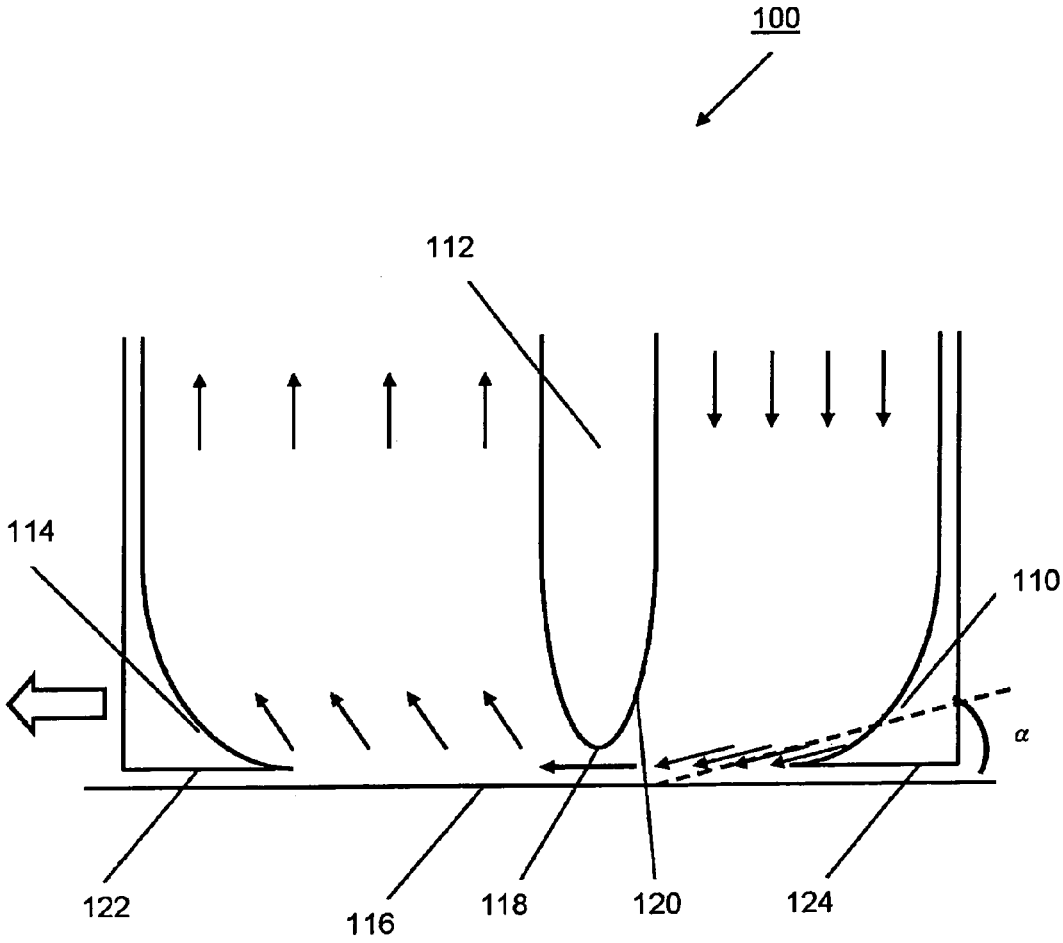
FIG. 1B is a simplified block diagram illustrating a cross sectional view of the pickup head according to a preferred embodiment of the invention.
Figure 1C:
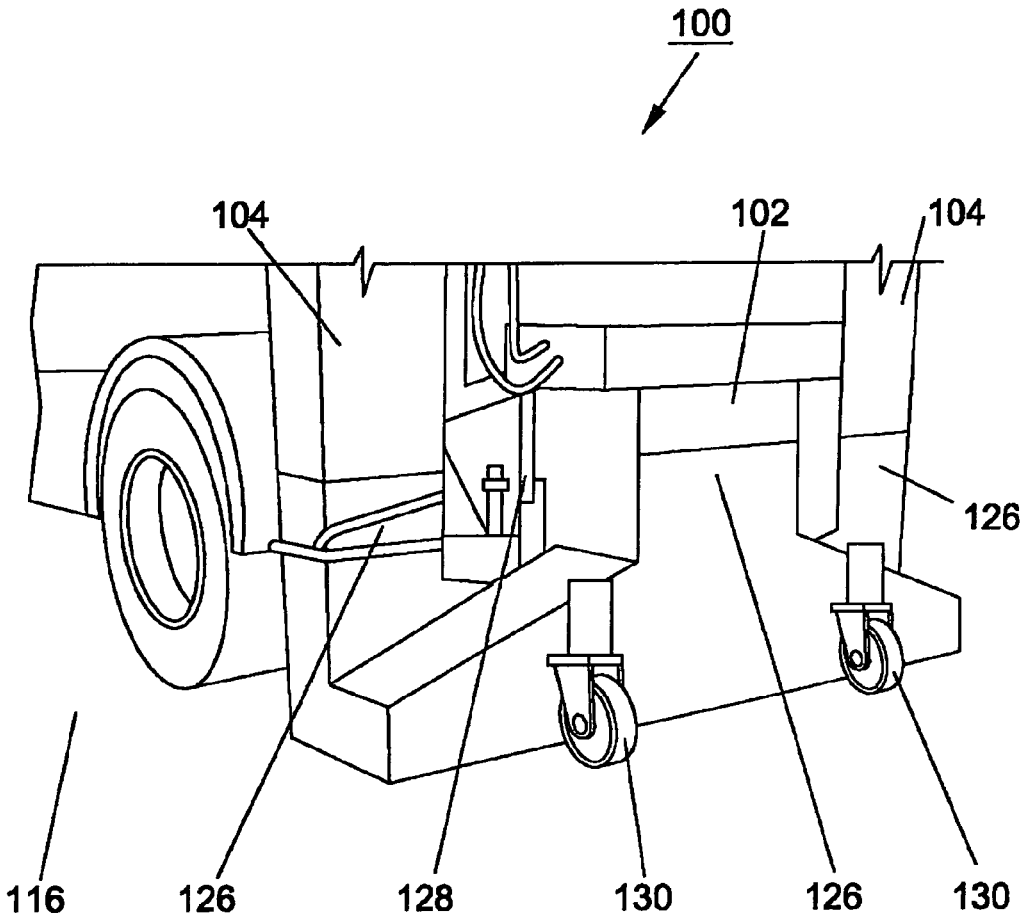
FIG. 1C is a simplified block diagram illustrating another perspective view of the pickup head mounted on a glycol recycling vehicle according to a preferred embodiment of the invention.

Referring to FIGS. 1A to 1C, a pickup head 100 according to a preferred embodiment of the invention is provided, the pickup head 100 being adapted for removing a de-icing or other liquid disposed on a solid surface. The pickup head 100 comprises an input port 102 for receiving an airflow and a blower opening 106 for providing the airflow to a solid surface 116. Blower deflector 110 preferably directs the airflow through the blower opening 106 at an acute angle $\alpha$ to the solid surface 116 as indicated by the arrows in FIG. 1B. The blower deflector 110 is preferably shaped such that the airflow is impacting on the solid surface at a predetermined acute angle $\alpha$ for atomizing a first portion of the de-icing liquid and rendering it airborne. For example, the surface of the blower deflector 110 is preferably curved as illustrated in FIGS. 1A and 1B or, alternatively, for example, may comprise one or more straight surface portions oriented such that the deflected airflow is impacting the solid surface at the predetermined acute angle $\alpha$. The acute angle $\alpha$ and the corresponding blower deflector 110 are determined, for example, in dependence upon: the type of liquid; the size of the blower opening 106; the mass and the speed of the airflow; and the amount of liquid to be atomized; using standard engineering technology.

The pickup head further comprises output ports 104 for being connected to a suction device providing suction, as will be described herein below. The airflow containing airborne de-icing liquid is received through suction opening 108 and provided through the output ports 104. Divider 112 is disposed between the blower opening 106 and the suction opening 108. A bottom end 118 of the divider 112 is placed at a predetermined distance to the solid surface 116 such that the airflow between the bottom end 118 of the divider 112 and the solid surface 116 has a velocity that is sufficient for removing a second portion of the de-icing liquid through shearing action and rendering it airborne. A bottom portion 120 of the blower side of the divider 112 and the blower deflector 110 are shaped such that they form together with the solid surface 116 a nozzle, the orifice of which being the gap between the bottom end 118 of the divider 112 and the solid surface 116. The shape of the bottom portion 120 of the blower side of the divider 112 together with the blower deflector 110 and the distance between the bottom end 118 of the divider 112 and the solid surface 116 are determined, for example, in dependence upon: the type of liquid; the size of the blower opening 106; the mass and the speed of the airflow; and the amount of liquid to be rendered airborne; using standard engineering technology. For example, in a preferred design a speed of the airflow through the gap between bottom end 118 of the divider 112 and the solid surface 116 is approximately 300 mph with the gap being approximately ¾ inch.

In a preferred embodiment of the present invention, a suction deflector 114 is provided, preferably being placed and designed for deflecting the airflow with the airborne portion of the liquid received through the suction opening 108 towards the output ports 104. Furthermore, in a preferred embodiment the suction deflector 114 is shaped such that the airflow emerging from the gap between the bottom end 118 of the divider 112 and the solid surface 116 expands for creating a low pressure zone which further causes a portion of the de-icing liquid to become airborne. For example, in a preferred embodiment of the present invention, the surface of the suction deflector 114 is curved as illustrated in FIGS. 1A and 1B or, alternatively, comprises one or more straight surface portions oriented such that the airflow is deflected towards the output ports 104. The shape of the suction deflector 114 together with the suction opening 108 are determined, for example, in dependence upon: the type of liquid; the amount of suction available at the output ports 104; the mass and the speed of the airflow; and the amount of liquid to be rendered airborne; using standard engineering technology.

A mechanism for reducing loss of the airflow of the pickup head 100 comprises flat surfaces 122, 124 disposed beneath the suction deflector 114 and the blower deflector 110, respectively, which are oriented substantially parallel to the solid surface 116. The flat surfaces 122, 124 have a predetermined width and are disposed at a predetermined distance to the solid surface 116. The narrow gap—of, for example, approximately ½ inch—causes a substantial restriction of the airflow significantly reducing the loss of the airflow.

The pickup head 100 is, for example, mounted to the rear of a recycling vehicle as illustrated in FIG. 1C. A lift mechanism 128—using, for example, a hydraulic cylinder—enables raising and lowering of the pickup head 100. During operation, the pickup head 100 is supported using a support mechanism such as, for example, casters 130 in order to place and keep the pickup head 100 at a predetermined distance to the solid surface 116. Conduits connected to the input port 102 and the output ports 104 comprise, for example, a section made of a flexible material 126 such as, for example, a rubber or plastic material providing sufficient flexibility to the conduits for enabling raising and lowering of the pickup head 100.

It is noted that the pickup head 100 according to a preferred embodiment comprises one input port 102 and two output ports 104. As is evident to one skilled in the art, the invention is not limited thereto but various other numbers of input ports and output ports are also employable.

It is further noted that the pickup head 100 is preferably moved parallel to the solid surface 116 in the direction indicated by the block arrow in FIG. 1B, but is of course not limited thereto and is also operable when moved in other directions parallel to the solid surface 116.

Figure 2:
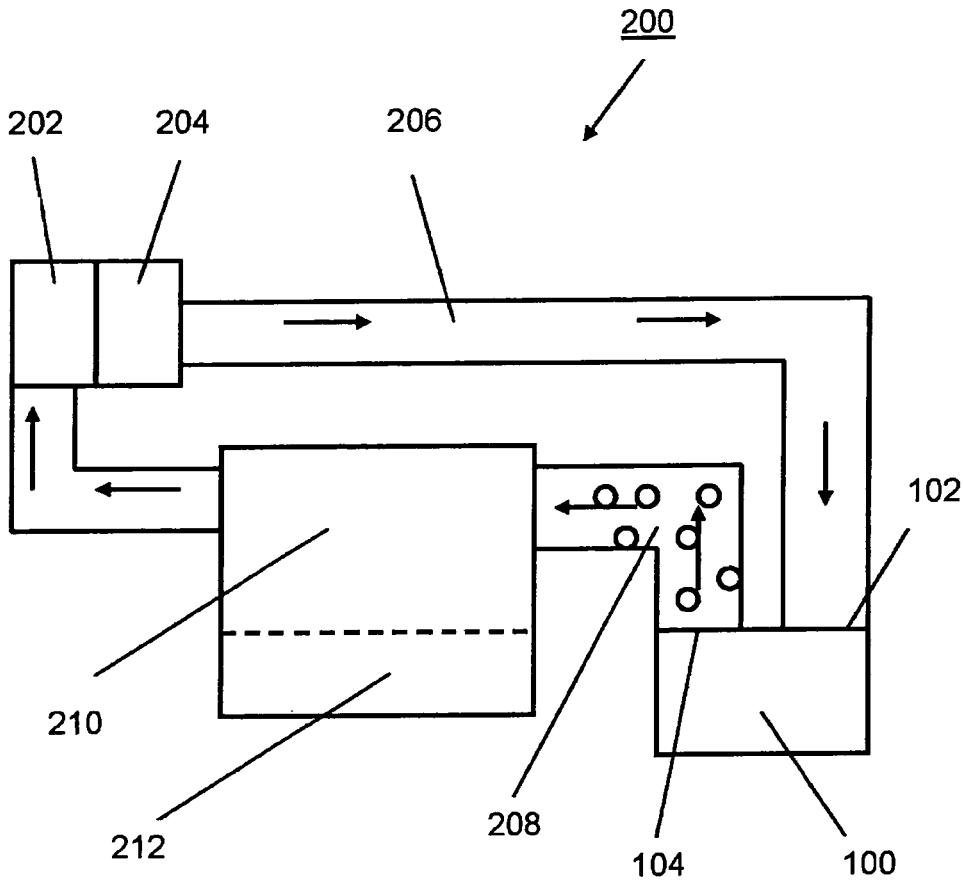
FIG. 2 is a simplified block diagram illustrating a de-icing liquid recovery device according to a preferred embodiment of the invention.
Figure 3A:
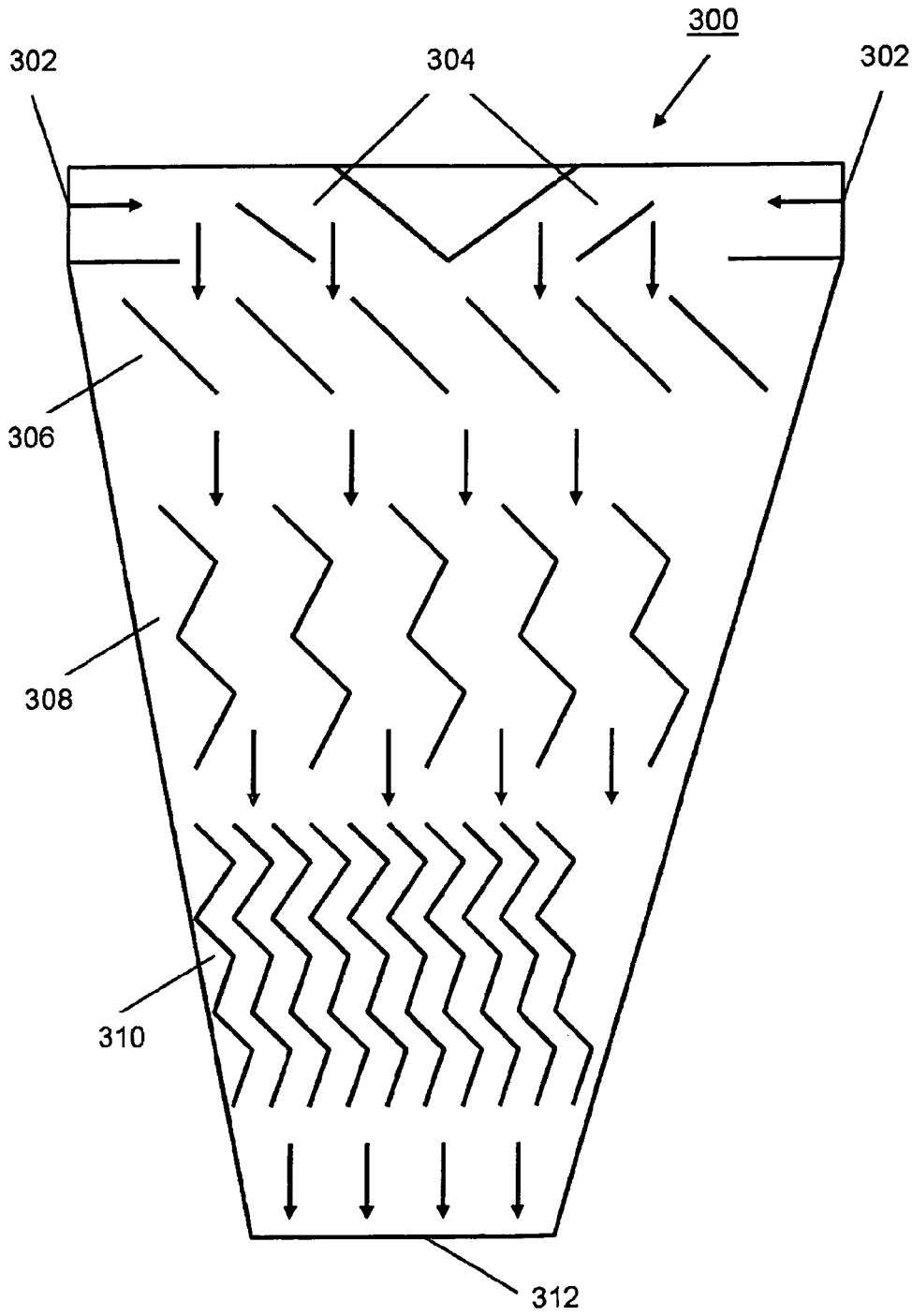
FIG. 3A is a simplified block diagram illustrating a cross sectional top view of a separator according to a preferred embodiment of the invention.

Referring to FIGS. 2 and 3A, a de-icing liquid recovery device 200 according to a preferred embodiment of the invention is provided. The de-icing liquid recovery device 200 comprises a suction device 202 for providing suction and a blowing device 204 for providing an airflow 206 to the input port 102 of the pickup head 100, as described above. The suction device 202 is, via separator 300, in fluid communication with the output port 104 of the pickup head 100 for providing suction thereto. The separator 300 according to a preferred embodiment of the invention will be described herein below, but the de-icing liquid recovery device 200 is not limited thereto and other types of separators such as, for example, cyclone type separators are also employable. The airflow with the airborne de-icing liquid 208 is provided to the separator 300 for separating the airborne de-icing liquid from the airflow and for collecting the separated de-icing liquid 212. Preferably, the suction device 202 is in fluid communication with the blowing device 204, thus providing a closed circuit for circulating the airflow from the suction side to the blowing side.

Preferably, the de-icing liquid recovery device 200 is powered by a 150 to 200 hp diesel engine. The diesel engine preferably powers a hydraulic pump—rated at approximately 150 hp or more—which by way of a hydraulic motor drives an air blower—for example, a centrifugal air blower—which draws air on the suction side and pumps the air into the blowing side of the closed circuit. Of course, numerous other embodiments of powering the de-icing liquid recovery device 200 will be apparent to those skilled in the art.

Referring to FIGS. 3A to 3D, a separator 300 according to a preferred embodiment of the invention is provided. The separator 300 comprises input ports 302 for receiving the airflow with the airborne portion of the de-icing liquid. Deflector 304 deflects and combines the airflows received at the input ports 302. The airflow then encounters a set of flat plates 306, preferably oriented at an angle of approximately 45° to the airflow. The deflector 304 and the set of flat plates 306 are dimensioned such that a substantial portion of slush and solid particles such as, for example, sand and dirt, as well as a first portion of the de-icing liquid impact there upon and then fall into collector 314 positioned below the deflectors and baffles referenced herein. Alternatively, other types of elongated structures having various cross sectional shapes—for example, triangles or parallelograms—and oriented at an appropriate angle to the airflow are employed.

Figure 3B:
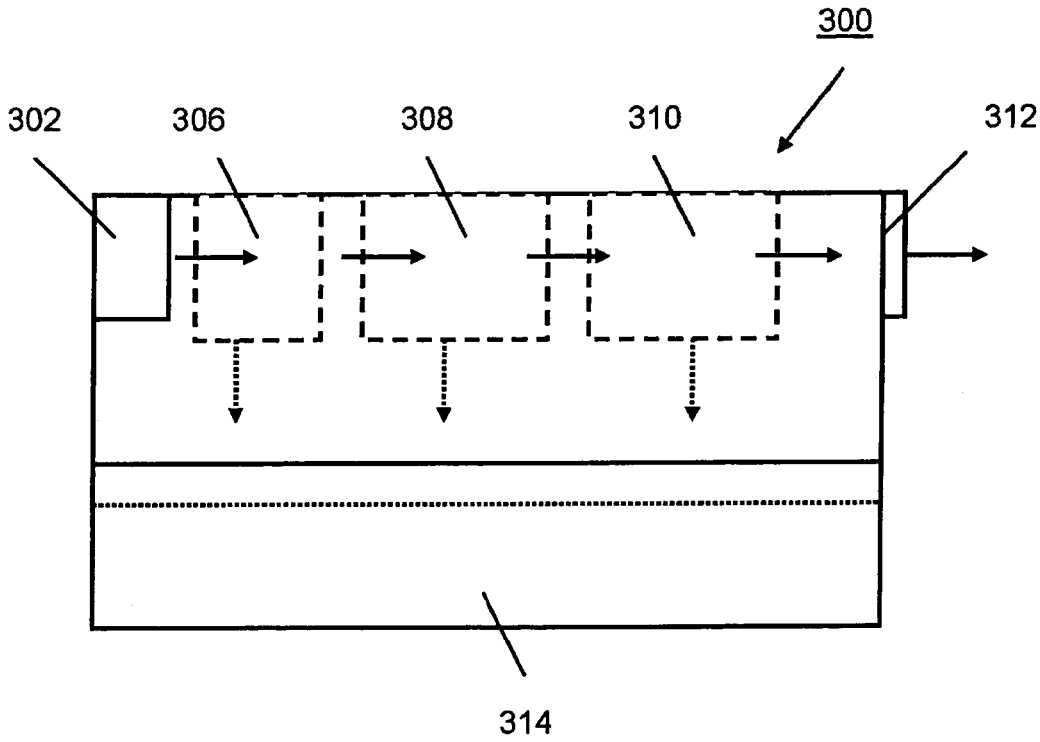
FIG. 3B is a simplified block diagram illustrating a cross sectional side view of the separator according to a preferred embodiment of the invention.

The airflow is then passed through two successive sets of baffles 308, 310 having different predetermined and decreasing coarseness before being passed through output port 312, as indicated by the arrows. The deflector 304, the plates 306, and the sets of baffles 308, 310 are disposed in an upper portion of the separator 300 which progressively narrows towards the output port 312, as illustrated in FIGS. 3A and 3B. De-icing liquid, slush, and solid particles impact on the flat plates, deflectors and baffles and then fall into the collector 314 through gravitational action. Optionally, the collector is separated into two portions with a first portion collecting the material removed from the airflow by the deflector and the plates 306 and a second portion collecting the material removed from the airflow by the two sets of baffles which contains a smaller amount of slush and solid particles.

Figure 3C:
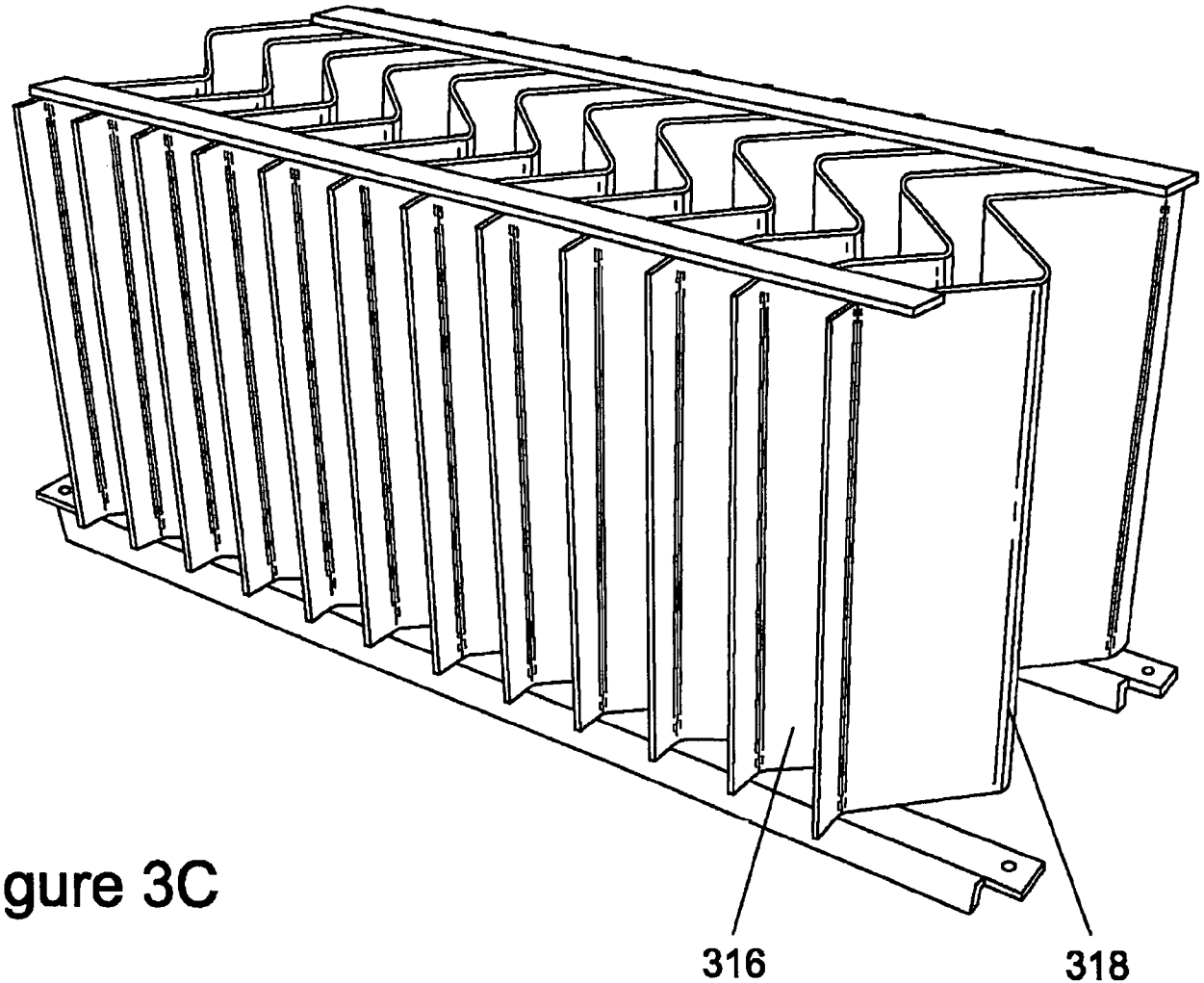
FIG. 3C is a simplified block diagram illustrating a perspective view of a set of baffles of the separator according to a preferred embodiment of the invention.
Figure 3D:
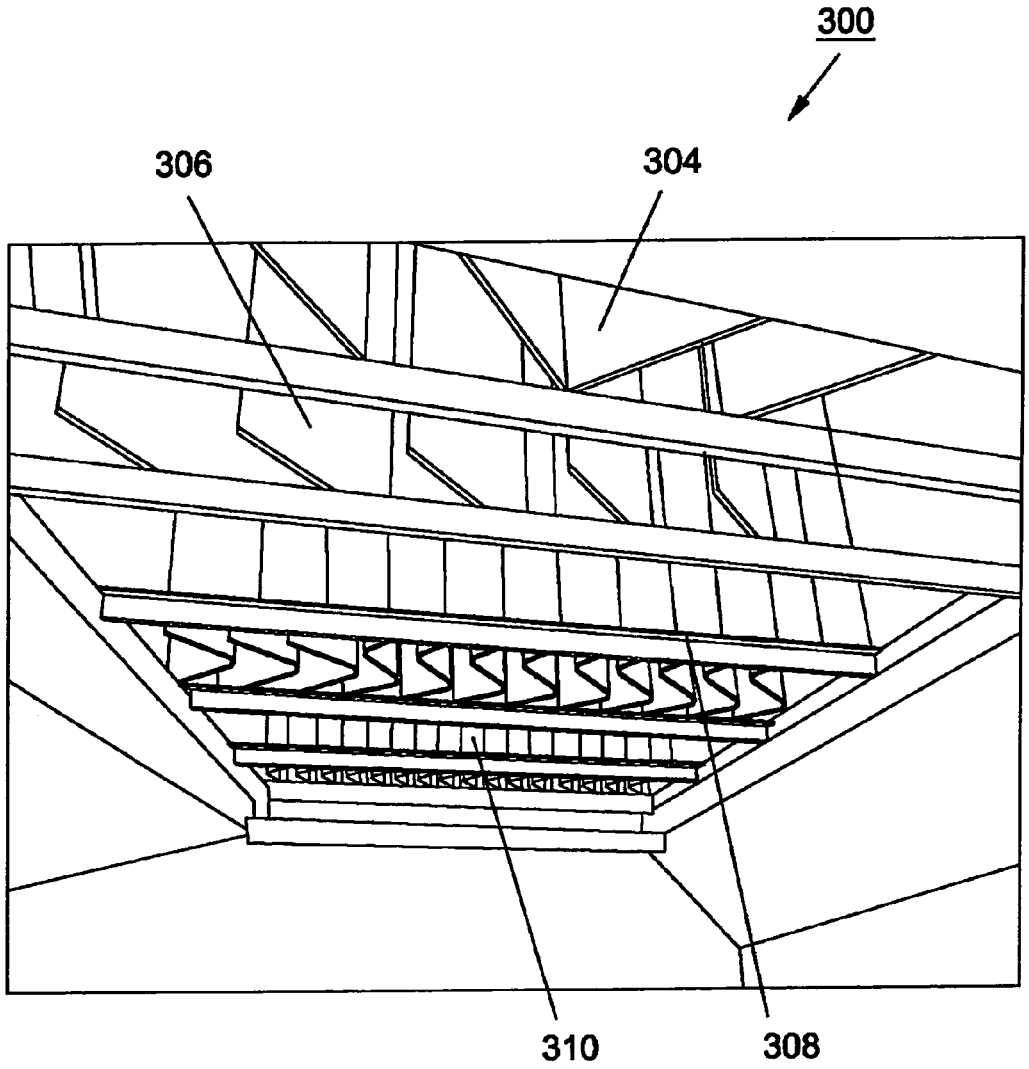
FIG. 3D is a simplified block diagram illustrating a perspective view of the upper portion of the separator according to a preferred embodiment of the invention.

Preferably, the sets of baffles 308, 310 are shaped to form chevron like channels for passing the airflow there through, as illustrated in FIGS. 3A, 3C and 3D. Alternatively, other types of baffles such as, for example, flat plates—or other types of elongated structures having various cross sectional shapes such as, for example, triangles or parallelograms—oriented at an appropriate angle to the airflow are employed. Further alternatively a different number—for example, 1, 2, 3, etc—of sets of baffles are employed.

The deflector 304, the plates 306, the sets of baffles 308, 310, and the upper portion of the separator are designed, for example, in dependence upon: the airflow; the suction; the type of airborne materials; and the amount of airborne materials, using standard engineering technology. Proper design of the separator 300 significantly reduces airflow losses when compared to comparable cyclone type systems.

Figure 4:
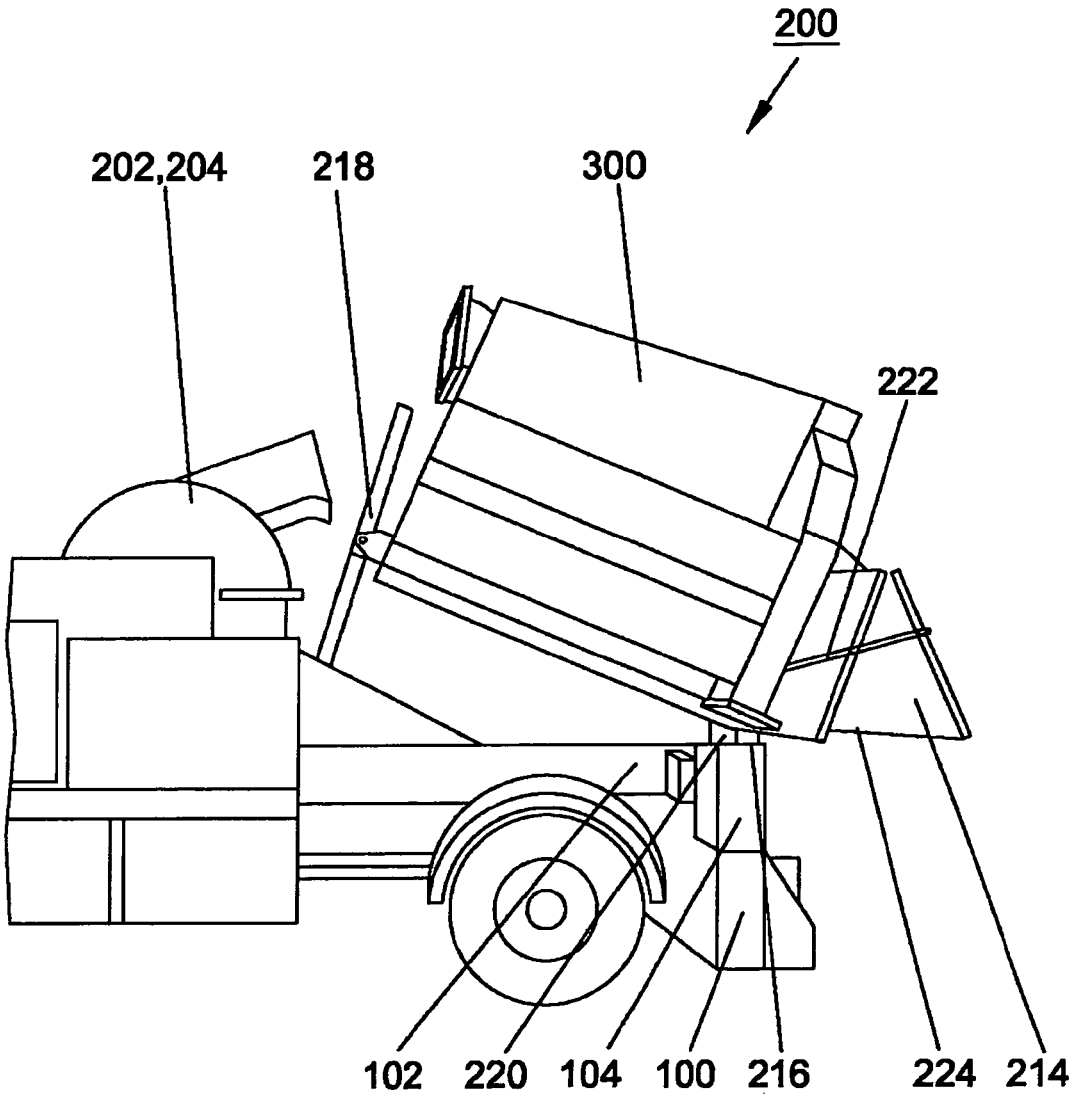
FIG. 4 is a simplified block diagram illustrating a side view of a preferred implementation of the de-icing liquid recovery device according to a preferred embodiment of the invention.

Referring to FIG. 4 a preferred implementation of the de-icing liquid recovery device 200 according to a preferred embodiment of the invention a raised position is illustrated mounted on a standard boxless truck, but is not limited thereto and also mountable onto, for example, a trailer. In this embodiment, the separator 300 is pivotally movable mounted 216 to a rear portion of the truck. A lift mechanism 218—for example, a hydraulic cylinder—lifts a front portion of the separator 300 for disposing of collected material such as slush and solid particles through rear opening 224 with door 214 being pivoted using opening mechanism 222 such as, for example, a hydraulic cylinder. Conduits 220 connecting the output ports 104 of the pickup head 100 to the input ports of the separator 300 as well as the conduit connecting the output port of the separator 300 to the suction device 202 comprise two portions which are mated in a sealed fashion when the de-icing liquid recovery device 200 is in operation and are separated when the front portion of the separator 300 is lifted as illustrated in FIG. 4. The conduit connecting the blower device 204 to the input port 102 of the pickup head 100 is placed on the truck below the separator 300.

The present invention has been described herein with regard to preferred embodiments. However, it will be obvious to persons skilled in the art that a number of variations and modifications can be made without departing from the scope of the invention as described herein.

What is claimed is:

1. A pickup head for removing a liquid disposed on a solid surface comprising:

at least an input port for receiving an airflow;

a blower opening for providing the airflow to the solid surface;

a blower deflector for directing the airflow through the blower opening at an acute angle to the solid surface, wherein the blower deflector is shaped such that the airflow is impacting on the solid surface at a predetermined angle for atomizing a first portion of the liquid and rendering it airborne;

a suction opening for receiving the airflow and an airborne portion of the liquid;

at least an output port for being connected to a suction device providing suction and for providing the received airflow with the airborne portion of the liquid there through; and, a divider disposed between the blower opening and the suction opening, wherein a bottom end of the divider is placed at a predetermined distance to the solid surface such that the airflow between the bottom end of the divider and the solid surface has a velocity that is sufficient for removing a second portion of the of the de-icing liquid through shearing action and rendering it airborne, and wherein a bottom portion of a blower side of the divider and the blower deflector are shaped such that the bottom portion of the blower side of the divider, the blower deflector, and the solid surface form a nozzle.

2. A pickup head for removing a liquid disposed on a solid surface as defined in claim 1 further comprising a mechanism for reducing loss of the airflow.

3. A pickup head for removing a liquid disposed on a solid surface as defined in claim 2 wherein the mechanism for reducing loss of the airflow comprises a flat surface having a predetermined width and for being disposed at a predetermined distance to the solid surface and oriented substantially parallel thereto, the flat surface bordering on at least one of the blower opening and the suction opening.

4. A pickup head for removing a liquid disposed on a solid surface as defined in claim 1 further comprising a support mechanism for supporting the pickup head on the solid surface at a predetermined distance thereto.

5. A pickup head for removing a liquid disposed on a solid surface as defined in claim 4 wherein the support mechanism comprises casters.

6. A pickup head for removing a liquid disposed on a solid surface as defined in claim 1 wherein the pickup head encapsulates the liquid using a regenerative circulatory airflow.

7. A device for recovering a liquid disposed on a solid surface comprising:

a suction device for providing suction;

a blowing device for providing an airflow;

a pickup head comprising:

at least an input port in fluid communication with to the blowing device for receiving the airflow;

a blower opening for providing the airflow to the solid surface;

a blower deflector for directing the airflow through the blower opening at an acute angle to the solid surface, wherein the blower deflector is shaped such that the airflow is impacting on the solid surface at a predetermined angle for atomizing a first portion of the liquid and rendering it airborne;

a suction opening for receiving the airflow and an airborne portion of the liquid;

at least an output port for providing the received airflow and the airborne portion of the liquid there through; and, a divider disposed between the blower opening and the suction opening, wherein a bottom end of the divider is placed at a predetermined distance to the solid surface such that the airflow between the bottom end of the divider and the solid surface has a velocity that is sufficient for removing a second portion of the of the de-icing liquid through shearing action and rendering it airborne, and wherein a bottom portion of a blower side of the divider and the blower deflector are shaped such that the bottom portion of the blower side of the divider, the blower deflector, and the solid surface form a nozzle;

and, a separator in fluid communication with the suction device and the at least an output port of the pickup head, the separator for providing suction to the at least an output port of the pickup head, for receiving the airflow and the airborne portion of the liquid, and for separating the airborne portion of the liquid from the airflow.

8. A device for recovering a liquid, disposed on a solid surface as defined in claim 7 wherein the suction device is in fluid communication with the blowing device for circulating the airflow.

9. A pickup head for removing a liquid disposed on a solid surface as defined in claim 7 wherein the pickup head encapsulates the liquid using a regenerative circulatory airflow.

10. A separator for separating a liquid from an airflow comprising:

an input port for receiving the airflow containing the liquid;

at least two sets of baffles in fluid communication with the input port, the sets of baffles having different predetermined coarseness and being disposed in series such that the airflow successively encounters the sets of baffles in order of decreasing coarseness;

an output port in fluid communication with the sets of baffles for providing the airflow after separation of the liquid there from; and, a collector disposed below the sets of baffles for collecting the liquid accumulated on the baffles through gravitational action.

11. A separator for separating a liquid from an airflow as defined in claim 10 wherein the sets of baffles form chevron-like channels for passing the airflow there through.

12. A separator for separating a liquid from an airflow as defined in claim 10 further comprising a cleaning mechanism for separating a substantial portion of slush and solid particles from the airflow.

13. A separator for separating a liquid from an airflow as defined in claim 12 wherein the cleaning mechanism comprises a set of flat plates oriented at an angle of approximately 45° to the airflow.

* * * * *